United States Patent [19]

Coppolani

[11] Patent Number: 4,967,540

[45] Date of Patent: Nov. 6, 1990

[54] SYSTEM FOR AUTOMATICALLY FILLING CANS WITH ELONGATED PRODUCTS SUCH AS FRENCH BEANS

[75] Inventor: Joseph Coppolani, Meudon-la-Foret, France

[73] Assignee: Femia Industrie, Paris, France

[21] Appl. No.: 408,378

[22] Filed: Sep. 18, 1989

[30] Foreign Application Priority Data

Sep. 21, 1988 [FR] France ..... 88 12345

[51] Int. Cl.[5] ..... B65B 1/08; B65B 39/12

[52] U.S. Cl. ..... 53/502; 53/245; 53/260; 53/475; 53/527

[58] Field of Search ..... 53/540, 536, 537, 502, 53/527, 245, 260, 259, 475, 167

[56] References Cited

U.S. PATENT DOCUMENTS

| | | | |
|---|---|---|---|
| 2,907,158 | 10/1959 | Labrozzi et al. | 53/260 X |
| 2,919,529 | 1/1960 | Hillman | 53/245 X |
| 4,183,192 | 1/1980 | Smaw | 53/444 |
| 4,506,492 | 3/1985 | Boyd | 53/473 |
| 4,514,959 | 5/1985 | Shroyer | 53/428 |
| 4,534,156 | 8/1985 | Smith | 53/260 X |
| 4,646,509 | 3/1987 | Tribert | 53/260 X |

*Primary Examiner*—James F. Coan

*Attorney, Agent, or Firm*—Kenyon & Kenyon

[57] ABSTRACT

A system for automatically filling cans with elongated products, comprising a chamber for filling an empty can and located above the can in a stationary filling position and a device for projecting successive groups of parallel elongated products through a side opening of the chamber as the filling chamber is moving downwards, the invention being in particular applicable to the filling of cans with French beans or carrots.

17 Claims, 5 Drawing Sheets

SYSTEM FOR AUTOMATICALLY FILLING CANS WITH ELONGATED PRODUCTS SUCH AS FRENCH BEANS

BACKGROUND OF THE INVENTION

The present invention relates to a system for automatically filling cans and like boxes or containers with elongated products such as French beans or carrots.

SUMMARY OF THE INVENTION

The filling system according to the invention is characterized in that it comprises a device for bringing an empty can with a horizontal filling opening to a stationary filling position; a can-filling chamber located above the can at the stationary position, with a side opening for receiving elongated products and with an opening bottom for feeding a predetermined amount of elongated products into the can, the filling chamber being displaceable vertically or in a direction inclined with respect to the vertical direction between an upper position and a lower position; and a device located upstream of the filling chamber and projecting through the side opening of the chamber successive groups of substantially parallel elongated products as the filling chamber moves from the upper position towards the lower position so as to form therein successive overlying layers of elongated products until it is filled with the desired predetermined amount of elongated products.

According to a feature of the invention, the projecting device comprises a belt conveyor for conveying parallel lines of elongated products arranged approximately side by side and forming the aforesaid groups, and moving lengthwise towards the filling chamber, the successive elongated products of each line being separated from one another by a predetermined distance and the filling chamber moving at a downward speed which is a function of the displacement velocity of the elongated products on the conveyor belt and of the predetermined distance between successive elongated products.

According to another feature of the invention, the system comprises upstream of the projecting device and along the direction of displacement of the elongated products a longitudinally vibrating aligning device adapted to spread out the elongated products and to align them up longitudinally into parallel lines and a longitudinally vibrating, preferably electromagnetic distributor device taking up the elongated products at the outlet of the aligning device and adapted to increase the distance of separation of or spacing between successive elongated products of each line and delivering the elongated products to the projecting device.

Advantageously, the displacement speed of the conveyor belt of the projecting device is relatively high with respect to the output speed of the elongated products from the distributor device so as to increase the distance of separation of or spacing between successive elongated products of each line to the aforesaid predetermined distance.

According to still another feature of the invention, the bottom of the filling chamber opens at the lower position of the latter and a push or thrust member is longitudinally moving within the filling chamber for transferring and ramming or packing or tamping the elongated products into the can.

Preferably, the bottom of the filling chamber consists of two flaps pivotally connected to two opposite sidewalls of the filling chamber, respectively, and opening downwards while moving away from each other.

Moreover, the system according to the invention comprises a device for weighing a batch of elongated products corresponding to the aforesaid predetermined amount of elongated products to be filled into the can and for discharging it into a hopper feeding the vibrating aligning device.

The system according to the invention further comprises a device for ejecting the filled can and the aforesaid supply device would position a new empty can at the filling position during the rise of the filling chamber.

The invention will be better understood and further objects, characterizing features, details and advantages thereof will appear more clearly as the following explanatory description proceeds with reference to the accompanying diagrammatic drawings given by way of a non limiting example only illustrating a presently preferred specific embodiment of the invention.

BRIEF DESCRIPTION OF THE DRAWINGS

For a fuller understanding of the invention, reference is made to the following description, taken in connection with the accompanying drawings, in which:

FIGS. 3A to 3F diagrammatically show the different operating phases or steps of the system according to the invention in particular for the filling of an empty can with elongated products.

DESCRIPTION OF THE PREFERRED EMBODIMENT

Figure 1:
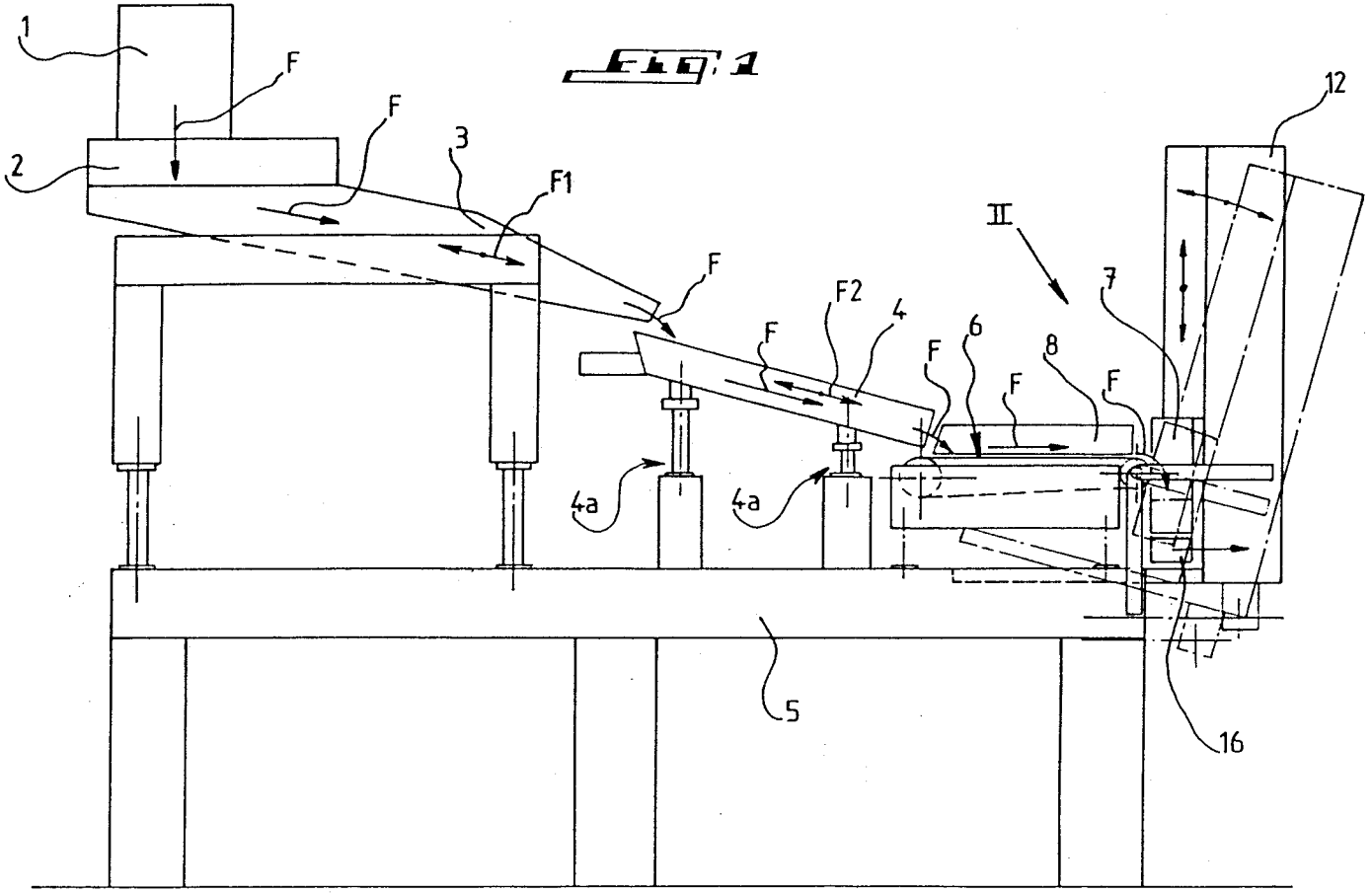
FIG. 1 diagrammatically shows the filling system according to the invention.

Referring to FIG. 1, the filling system according to the invention at first comprises along the direction of displacement of the elongated products from left to right on this figure, a weighing device 1, known per se, allowing to weigh a batch of elongated products such as French beans corresponding to the net weight of products to be put into a can. This batch once weighed is then discharged into a hopper 2 for feeding elongated products to an aligning device 3 of the system longitudinally vibrating in the direction shown by the double arrow F1 and adapted to spread out the elongated products of a batch and to line them longitudinally up into parallel lines. The vibrating aligning device also known per se is of the kind comprising a vibrating tray comprising parallel channels or troughs in which the elongated products would longitudinally draw up into parallel lines. The aligning device 3 is inclined downwards with respect to the horizontal plane along the direction of displacement of the elongated products denoted by the arrows F.

The system further comprises a distributor device 4 preferably also inclined downwards and receiving the elongated products issuing from the aligning device 3, the upstream end of the distributor device 4 being located below the outlet of the aligning device 3. The distributor device 4 is of the type vibrating preferably electromagnetically, lengthwise along the direction of the double arrow F2 and is of the kind comprising a tray with parallel channels or troughs arranged in aligned relationship with respect to the parallel troughs of the aligning device 3, respectively. The distributor device 4 would take up the elongated products at the outlet of the aligning device 3 so as to increase the distance of separation of or spacing between the elongated products in a same line. The vibration frequency of the distributor device 4 is variable and the slope of the latter may be adjusted by means of parts 4a secured on the one hand to the frame 5 of the system and on the other hand underneath the device 4.

A projecting device 6 takes up the elongated products at the outlet of the distributor device 4 and is projecting them into the filling chamber 7 as described hereinafter. As better shown on FIG. 2, the projecting device 6 is, in the present instance, of the endless belt 6a type, reeved at both of its ends over a driving roll 6b and a driven roll 6c, respectively, and driven by an electric motor 6d the output shaft of which comprises a driving wheel 6e connected to the driving roll 6b through the agency of a transmission belt 6f, the motor 6d being rigidly secured to the frame 5. Above the upper horizontaly conveying side 6a1 of the endless belt 6a is arranged a stationary tray 8 comprising parallel longitudinal grooves opening just above the belt side 6a1 so as to guide the longitudinal displacement of the elongated products in parallel lines on the moving belt side 6a1. The parallel guide grooves of the tray 8 are, of course, arranged in aligned registering relationship with respect to the parallel troughs of the distributor device 4. The linear displacement speed of the conveyor belt 6a which is adjustable hence the travel velocity of the elongated products on the belt side 6a1, is relatively high for instance of 1 to 2 m/s, with respect to the output speed of the elongated products from the distributor device so as to increase the distance of separation of or spacing between the successive elongated products located in each line formed by the corresponding groove of the tray 8. The linear displacement speed of the endless belt 6 is adjustable in accordance with characteristics such as the weight of the elongated products.

Downstream of the projecting device 6 is arranged the filling chamber 7 having approximately the shape of a rectangular parallelepiped the side wall of which adjacent to the outlet of the device 6 comprises a, for instance, rectangular opening 7a for receiving the elongated products. The chamber 7 comprises an opening bottom 7b consisting, for instance, of two flaps mounted in pivotally connected relationship onto parallel opposite side walls, respectively, of the chamber at right angles to the side wall formed with the opening 7a and opening downwards while moving away from each other until they are substantially parallel in a lower position of the filling chamber 7 to two opposite side walls. By way of example, each pivot pin of the corresponding flap is rigidly fastened to or made integral with the latter and is rotatably mounted between both opposite side walls at its two ends, a resilient drawback member, such as a spring keeping the flap normally closed. In the upper position of the chamber 7 shown on FIG. 2, the bottom 7b thereof is at a predetermined distance below the horizontal plane containing the upper side 6a1 of the endless belt 6. The chamber 7 is rigidly fastened to or made integral with a holder 9 which also supports an actuator jack or ram 10 for operating the displacement of a rod 10a having a piston 11 through the chamber 7 along the longitudinal center line axis thereof. The actuator 10 is accordingly mounted above the chamber 7 in coaxial relation to the latter, the piston 11 being retracted in an inoperative position above the horizontal plane containing the upper side 6a1 of the endless belt 6. The holder 9 is mechanically connected to a frame 12 through the medium of an assembly allowing same to be driven in translatory motion between an upper position and a lower position. Such an assembly may consist for instance of a slide 9a of the support 9 engaging a corresponding guide groove defined in a guide plate 13 rigidly fastened to or integral with the frame 12, whereas the slide may have a T-like or dovetail shape. The displacement of the slide 9a hence of the supporting plate 9 is carried out in the present case by means of an endless screw or worm 14 driven by an electric motor 15 rigidly fastened to the frame 12, the worm being rotatably mounted in two lengthwise spaced bearings rigidly fastened to the guide plate 13, the worm driving the slide 9a. The frame 12, the electric motor 15, the worm or endless screw 14, the guide plate 13, the supporting plate 9, the actuator 10 and the filling chamber 7 form together a unitary assembly which may either assume a vertical position so that the bottom 7b of the filling chamber 7 be parallel to the upper horizontal side 6a1 of the endless belt 6 or be slightly inclined with respect to the vertical direction towards the right as shown in an exaggerated fashion on FIG. 2 so that the bottom 7b of the filling chamber 7 be inclined in relation to the upper side 6a1 of the endless belt 6. This inclination is carried out about a lengthwise axis coinciding with the lengthwise center line axis of the driven roll 6c extending at right angles to the plane of FIG. 2.

An empty can or box 16 to be filled, for instance of approximately rectangular or square cross-section and with a horizontal filling opening is brought into filling position underneath the filling chamber 7 vertically below the latter. A device not shown for instance of the jack type pushes an empty can selected from a line of cans onto a guide track or rail 17 rigidly fastened to the frame 5 until it is brought into the filling position.

The operation of the system according to the invention follows already partly from the description thereof which has been made hereinabove and which will be now stated in greater detail.

The elongated products such for instance as French beans, are previously sorted according to their lengths before being fed to the weighing device 1 in order to provide a batch of elongated products of homogeneous lengths to be filled into the can.

The elongated products are thus inserted into the weighing device 1 so that the latter discharges the desired amount of elongated products into the hopper feeding the vibrating aligning device. The elongated products drawn up lengthwise in parallel lines are taken up by the vibrating distributor device 4 which increases the distance of separation between successive elongated products in each line and feeds the projecting device 6. The moving upper side 6a1 of the conveyor belt 6a takes up the elongated products coming from the distributor device 4 while keeping them aligned by the tray formed with longitudinal parallel grooves just above the belt side 6a1 and, as previously mentioned, further increases the spacings between the successive elongated products of each line.

Referring to FIGS. 3A to 3F, the process of filling the chamber 7 and the feeding of the batch in predetermined amounts of elongated products into the empty can to be filled will be described.

Figure 2:
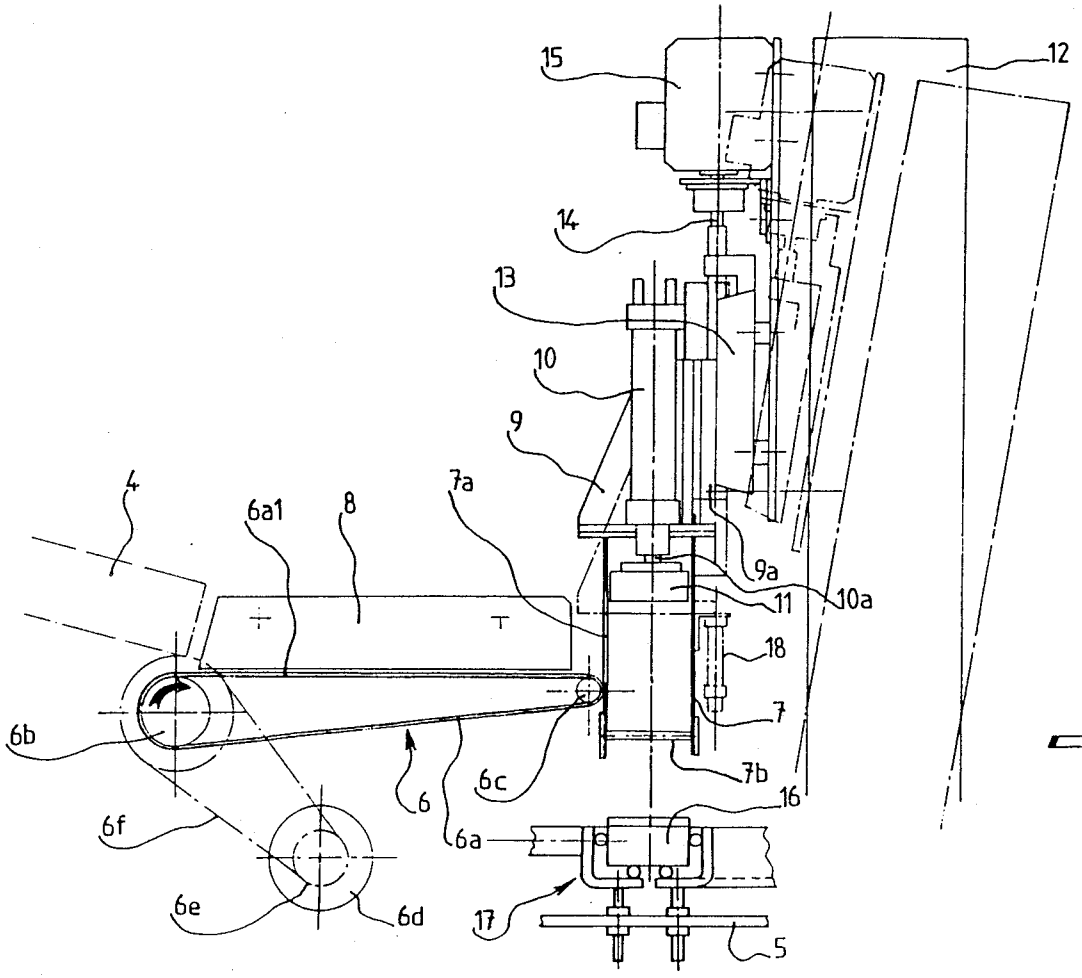
FIG. 2 is an enlarged detail view of a part of the filling system of the invention taken along the arrow II of FIG. 1.
Figure 3B:
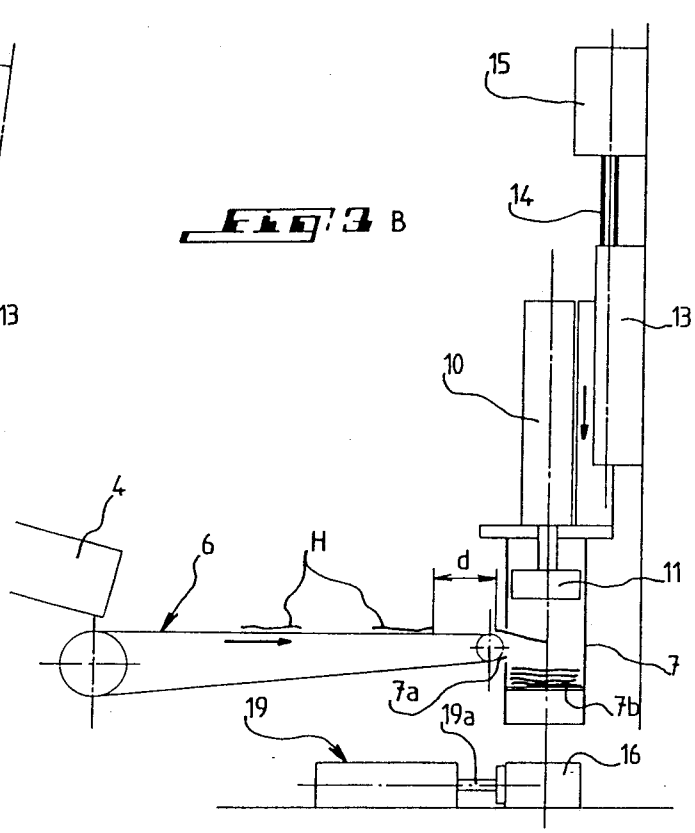
Figure 3A:
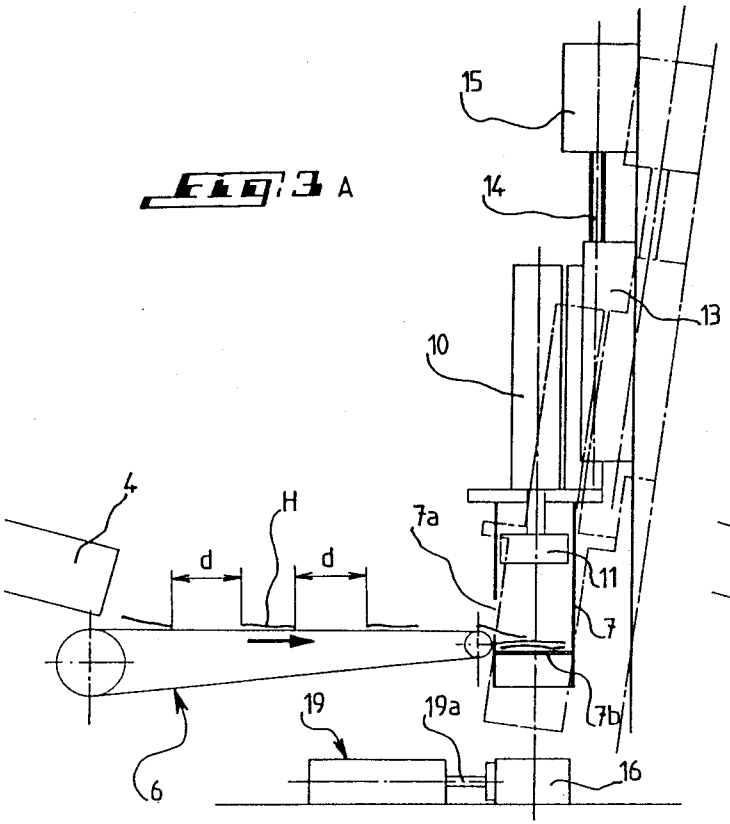
Figure 4D:
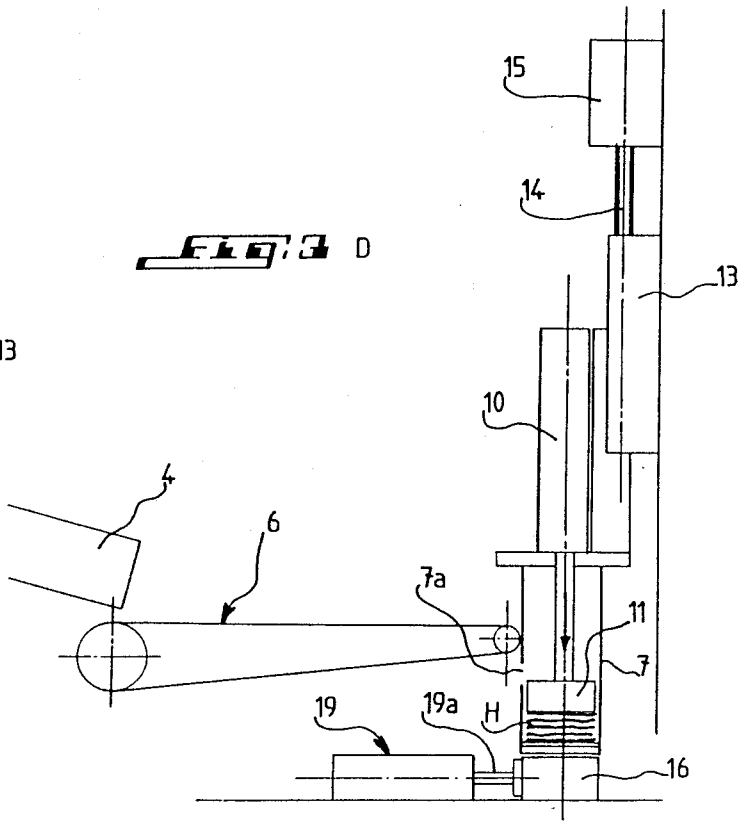
Figure 4C:
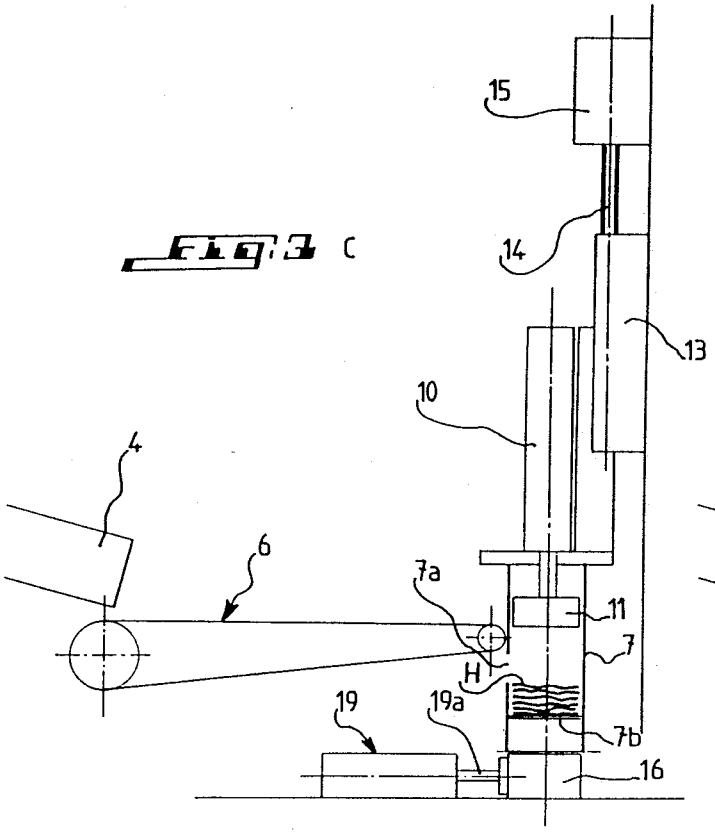
Figure 4F:
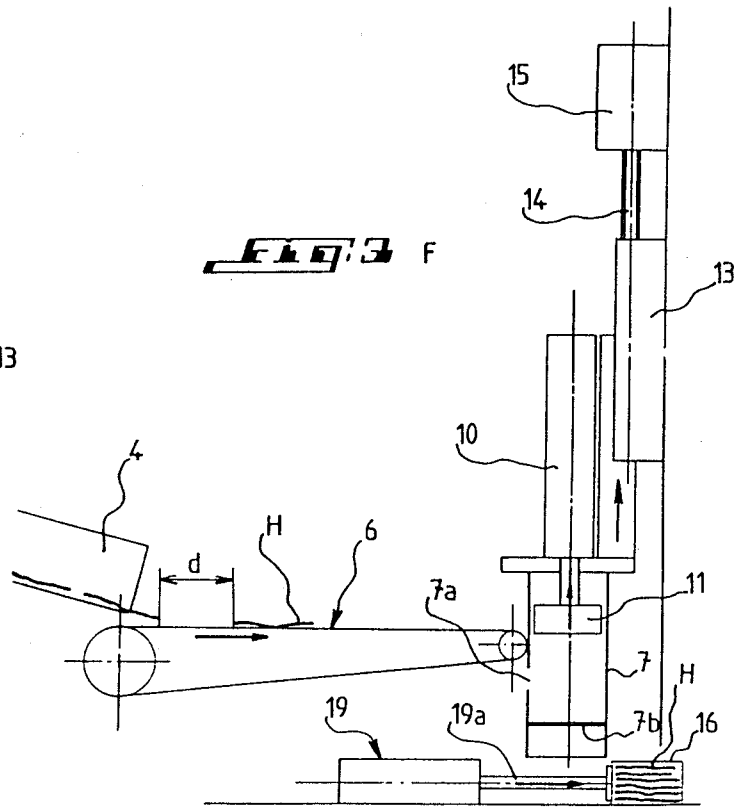
Figure 4E:
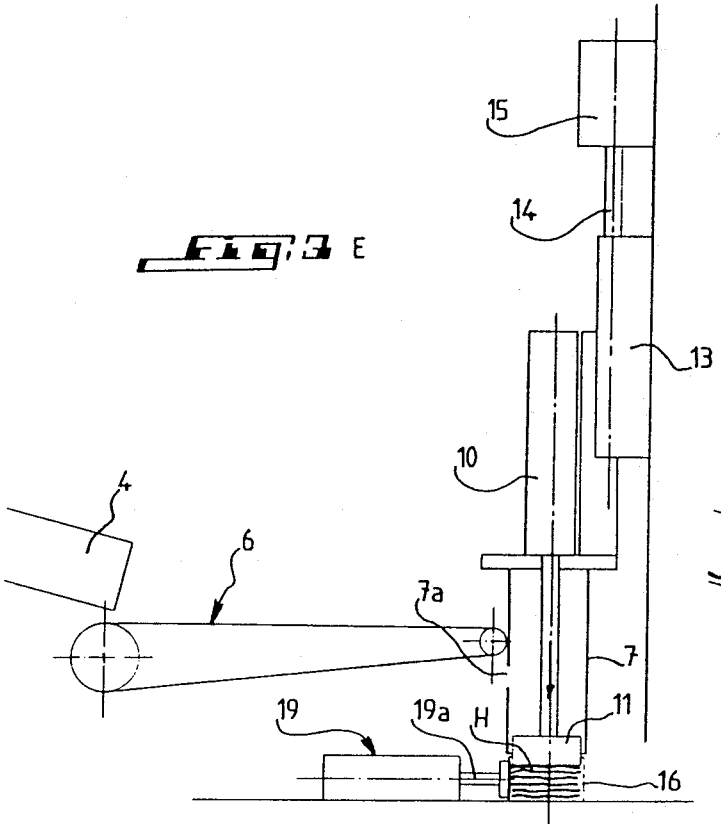

The FIGS. 3A and 3B show the elongated products H of a line separated from each other by a substantially equal distance d and projected successively by the conveyor belt 6 into the filling chamber 7 through the opening *7a*. Thus, a number of substantially parallel elongated products H arranged approximatively side by side and guided by the guide grooves, respectively, of the tray 8 present in a corresponding number are projected approximatively simultaneously down to the bottom of the chamber 7 to form successive overlying layers of elongated products as the filling chamber 7 moves downwards from its upper position shown on FIG. 2. The lowering motion speed of the chamber 7 is a function of the travel velocity of the elongated products H on the upper side 6a1 of the conveyor belt 6a and of the predetermined distance d between successive elongated products of each line. FIG. 3C shows the chamber 7 filled with a batch of elongated products H and in the lower position (bottom dead center). In this position, both flaps of the bottom *7b* would open automatically while spreading apart from each other and the jack actuator 10 is operated so that the piston 11 provides for the transfer of the batch of elongated products into the can 16 as shown in FIGS. 3D and 3E. By way of example, the automatic opening of both flaps of the bottom *7b* may be carried out through the medium of a ram actuator 18 shown in dash-dotted lines on FIG. 2 illustrating the lower position of the chamber 7 and the rod of which is acting through a suitable link mechanism to drive the pivot axis of each flap through a predetermined angle.

When the can 16 is filled up, a device comprising for instance a jack actuator. 19 with a thrust rod 19a for pushing the can 16 would eject the latter out of the filling position and towards a place where the can is to be closed, this transfer being carried out through the agency of a guide track or rail (not shown) extending at right angles to the guide rail 17. This operating step is carried out during the rise of the filling chamber 7 and the rise of the piston 11, a new batch of elongated products arriving on the conveyor belt 6 while the feed device is feeding a new can 16 to be filled underneath the filling chamber 7.

The number of parallel throughs of the aligning device 3 and of the distributor device 4 and of grooves of the tray 8 would of course depend of the number of parallel products forming a layer required to fill the can 16 up to a corresponding level. Moreover, the feed hopper, the aligning device 3, the distributor device 4 and the projecting device 6 may be divided each one into two sections placed side by side, separated by a partition and corresponding to two independent filling chambers 7, respectively, arranged in parallel relationship in order to increase the output or efficiency of the system according to the invention. At last, a logic circuit adapted to operate the various components of the system according to the invention may be easily designed by anybody skilled in or conversant with the art starting from the various operating steps of the filling system described hereinabove.

What is claimed is:

1. A system for automatically filling cans with elongated products such as French beans, wherein the improvement comprises a device for supplying an empty can having a horizontal filling opening to a stationary filling position; a can-filling chamber located above the can at a stationary filling position and having a side opening for receiving elongated products and an opening bottom for feeding a predetermined amount of elongated products into the can, the filling chamber being adapted to move vertically or in an inclined direction with respect to the vertical direction between an upper position and a lower position; and upstream of the filling chamber a device for projecting through the side wall of the chamber successive groups of substantially parallel elongated products as the filling chamber moves from the upper position down to the lower position so as to form therein successive overlying layers of elongated products until the can is filled with the desired predetermined amount of elongated products.

2. A system according to claim 1, wherein said projecting device comprises a belt conveyor for carrying parallel lines of elongated products arranged approximatively side by side and forming said groups, the conveyor moving longitudinally towards the filling chamber, the successive elongated products of each line being separated from each other by a predetermined distance and wherein the filling chamber is moving at a lowering motion speed which a a function of the deplacement velocity of the elongated products on the conveyor belt and of the predetermined distance between successive elongated products.

3. A system according to claim 2, further comprising upstream of the projecting device and along the displacement direction of the elongated products an aligning device vibrating lengthwise and adapted to spread out the elongated products and to align them longitudinally into parallel lines and a distributor device vibrating lengthwise, taking up the elongated products issuing from the aligning device and adapted to increase the distance of separation of successive elongated products of each line and delivering the elongated products to the projecting device.

4. A system according to claim 3, wherein the displacement speed of the conveyor belt of the projecting device is relatively high with respect to the output speed of the elongtated products from the distributor device so as to increase the spacings between successive elongated products of each line to said predetermined distance.

5. A system according to claim 1, wherein the bottom of the filling chamber opens in the lower position of the latter and a push member moves longitudinally within the chamber to transfer and tamp the elongated products into the can.

6. A system according to claim 5, wherein the bottom of the filling chamber consists of two flaps pivotally connected to two parallel opposite side walls, respectively, of the chamber, which open downwards while moving away from each other in the lower position of the chamber.

7. A system according to claim 5, wherein the push member is shaped as a piston operated by a jack actuator mounted in coaxial relationship above the filling chamber.

8. A system according to claim 3, further comprising a device for weighing a batch of elongated products corresponding to said predetermined amount of elongated products to be filled into the can and discharging it into a hopper feeding the vibrating aligning device.

9. A system according to claim 1, wherein the filling chamber is displaced by a driving device consisting of an electric motor and of a worm.

10. A system according to claim 1, further comprising a device for ejecting the filled can and wherein said supply device is bringing a new empty can above the filling chamber during the rise of the latter.

11. A system according to claim 3, wherein said vibrating aligning and distributor devices are provided each one with parallel troughs in which the elongated products are moving lengthwise in parallel lines.

12. A system according to claim 2, wherein the projecting device comprises a stationary tray formed with parallel grooves for guiding the elongated products and arranged just above the upper side of the conveyor belt.

13. A system according to claim 8, wherein the feed hopper, the aligning device, the distributor device, the projecting device are each one divided into two sections arranged side by side, separated by a partition and corresponding to two independent parallel filling chambers, respectively.

14. A system according to claim 3, wherein said distributor device is of an electromagnetic type.

15. A system for automatically filling cans with elongated products such as French beans, comprising a device for supplying an empty can having a horizontal filling opening to a stationary filling position; a can-filling chamber located above the can at a stationary filling position of the latter and having a side opening for receiving elongated products and an opening bottom for feeding a predetermined amount of elongated products into the can, the filling chamber being adapted to move vertically or in an inclined direction with respect to the vertical direction between an upper position and a lower position; and upstream of the filling chamber a device for projecting through the side wall of the chamber successive groups of substantially parallel and approximately side by side elongated products as the filling chamber moves from the upper position down to the lower position so as to form therein successive overlaying layers of elongated products until the can is filled with the desired predetermined amount of elongated products; and wherein the successive groups of products are separated from each other by a predetermined distance and the feeding chamber is moving at a lowering motion speed which is a function of the displacement velocity of the elongated products and of the predetermined distance between successive groups of products.

16. A system according to claim 15, wherein said projecting device includes a belt conveyor for carrying parallel lines of elongated products and moving longitudinally towards the filling chamber.

17. A system for automatically filling cans with elongated products such as French beans, comprising a device for supplying an empty can having a horizontal filling opening to a stationary filling position; a can-filling chamber located above the can at a stationary filling position of the latter and having a side opening for receiving elongated products and an opening bottom for feeding a predetermined amount of elongated products into the can, the filling chamber being adapted to move vertically or in an inclined direction with respect to the vertical direction between an upper position and a lower position; and upstream of the filling chamber a device for projecting through the side wall of the chamber successive groups of substantially parallel and approximately side by side elongated products as the filling chamber moves from the upper position down to the lower position so as to form therein successive overlaying layers of elongated products until the can is filled with the desired predetermined amount of elongated products; and wherein said projecting device includes a belt conveyor for carrying parallel lines of elongated products and moving longitudinally towards the filling chamber, the successive groups of elongated products are separated from each other by a predetermined distance and the filling chamber is moved at a lowering motion speed which is a function of the displacement velocity of the elongated product on the conveyor belt and of the predetermined distance between successive groups of elongated products.

* * * * *